US006137966A

United States Patent [19]

Uehara et al.

[11] Patent Number: 6,137,966

[45] Date of Patent: Oct. 24, 2000

[54] IMAGE FORMING APPARATUS

[75] Inventors: Shinji Uehara, Shizuoka-ken; Jun Suzuki, Numazu, both of Japan

[73] Assignee: Canon Kabushiki Kaisha, Tokyo, Japan

[21] Appl. No.: 09/289,736

[22] Filed: Apr. 12, 1999

[30] Foreign Application Priority Data

Apr. 16, 1998 [JP] Japan ..... 10-122996

[51] Int. Cl.[7] ..... G03G 15/00

[52] U.S. Cl. ..... 399/13; 399/111

[58] Field of Search ..... 399/9, 13, 110, 399/111, 113, 114

[56] References Cited

U.S. PATENT DOCUMENTS

| | | | |
|---|---|---|---|
| 4,933,718 | 6/1990 | Furuya | 399/13 |
| 4,952,974 | 8/1990 | Mori | 399/13 |
| 5,038,173 | 8/1991 | Kusumoto | 399/13 |
| 5,311,253 | 5/1994 | Ohmori et al. | 399/13 |
| 5,790,927 | 8/1998 | Ando et al. . | |
| 5,893,006 | 4/1999 | Kanno et al. | 399/13 |
| 5,909,603 | 6/1999 | Suzuki et al. . | |

FOREIGN PATENT DOCUMENTS

| | | |
|---|---|---|
| 59-061854 | 4/1984 | Japan . |
| 6-149051 | 5/1994 | Japan . |

*Primary Examiner*—Sandra Brase
*Attorney, Agent, or Firm*—Fitzpatrick, Cella, Harper & Scinto

[57] ABSTRACT

An image forming apparatus allowing a user to easily recognize the status thereof and is capable of accurately deciding whether a detachable unit is attached to an apparatus body or not. It includes a unit detachably attachable to the main body of the apparatus. The detachable unit includes an information storaging apparatus, a unit attachment detector for detecting whether the unit is attached to the main body of the apparatus or not, a biasing apparatus for biasing the detachable unit so that an information transmission can be properly made between the main body of the apparatus and the information storaging apparatus. The biasing apparatus is operable when the attachment of the detachable unit is detected by the unit attachment detector and an information transmission detector for detecting whether information transmission is executable between the information storaging apparatus and the main body of the apparatus or not. The information transmission detector starts a detecting operation after the working of the biasing apparatus.

14 Claims, 9 Drawing Sheets

IMAGE FORMING APPARATUS

BACKGROUND OF THE INVENTION

1. Field of the Invention

The present invention relates to an image forming apparatus such as a copier or a printer, in particular to an image forming apparatus with an unit detachably attachable to a main body of the apparatus.

2. Related Background Art

Formerly, an electrophotographic image forming apparatus using an electrophotographic image forming process, for example, employed a process cartridge system making an electrophotographic photosensitive body and process means for acting on the electrophotographic photosensitive body into an integrated cartridge and permitting this cartridge to be detachably attachable to the main body of the image forming apparatus. According to this cartridge system, since the maintenance of an apparatus was performable by a user himself, not by a service man, the manipulability could be markedly improved. Thus, this process cartridge system has been widely applied to an electrophotographic image forming apparatus.

Incidentally, the above process cartridge system is a system integrally making charging means or cleaning means, developing means, and an electrophotographic photosensitive body into a cartridge and permitting the cartridge to be detachably attachable to the main body of an electrophotographic image forming apparatus, or integrally making at least one of charging means and cleaning means, developing means, and an electrophotographic photosensitive body into a cartridge and permitting the cartridge to be detachably attachable to the main body of the electrophotographic photosensitive body, or integrally making an electrophotographic photosensitive body and cleaning means into a cartridge and permitting the cartridge to be detachably attachable to the main body of the electrophotographic photosensitive body.

A process cartridge made by unitizing members necessary for image forming like this is put to practical use to facilitate a maintenance operation such as, the replenishment of a developer or the exchange of a photosensitive body in case a developer or a electrophotographic photosensitive body or the like is used up.

Also, for the process cartridge described above, an additional function has been proposed, for example, of mounting a nonvolatile RAM in a process cartridge as a storing medium, storing the amount used at the main body of an image forming apparatus into this nonvolatile RAM and discriminating the usage limit of a process cartridge on the basis of the information to notify a user of the timing of exchange or urging an exchange as disclosed in Japanese Patent Application Laid-Open No. 59-61854, or of storing a quality code in the above nonvolatile RAM at the time of shipping and disabling the image forming operation unless the quality code coincides with that of the main body of an image forming apparatus for the protection of an apparatus as disclosed in Japanese Patent Application Laid-Open No. 6-149051.

And, in a former image forming apparatus, a connector is generally used in the connection between the nonvolatile RAM loaded on a process cartridge and the main body of an image forming apparatus to permit the process cartridge to be detachably attachable to the main body of the image forming apparatus.

The connector is installed with an easy connection elaborated in attaching a process cartridge to the main body of an image forming apparatus, but consideration is required of using high precision components around the connector or of adopting an easily connecting connector shape for the improvement of reliability in the connection.

Also, when a connection fault of the connector occurs in an image forming apparatus communicating to a storing medium loaded on a process cartridge and detecting the presence or absence of a process cartridge, for example, processing is made by mistake with the process cartridge regarded as unloaded even if it is loaded correctly.

And, when the above storing medium or the connector itself is faulty, processing is made with the process cartridge regarded as unloaded and erroneous information is given to an operator even if the connection of the above connector is securely achieved.

Furthermore, with an image forming apparatus in which the detection of an abnormality in storing medium itself is detected, for example, the occurrence of connection fault in the above connector is processed as an abnormal storing medium by mistake even if the storing medium itself is not abnormal. In this case, because of performing various controls on the basis of an erroneous detected result, the image forming apparatus is damaged in operating stability, thus resulting in a decrease in reliability.

Recently, use of a non-contact antenna for information transmission between the main body of the apparatus and the storing medium of a process cartridge is also proposed.

Those using such non-contact type of communicating means have the merit of being easier in the attachment and detachment of a process cartridge than those using a contact-type of connector as mentioned above.

To perform an accurate communication, however, the positional tolerance of an antenna on the process cartridge side to an antenna on the main body of the apparatus side is restricted to some extent. Accordingly, if the position of an antenna on the process cartridge side exceeds this tolerance in attaching the process cartridge to the main body of the apparatus, a problem similar to that of an apparatus using a contact-type connector occurs.

Thus, to improve the reliability of connecting a connector on the process cartridge side to a connector on the main body of the apparatus side when the process cartridge is attached to the main body of the apparatus, the provision of a biasing means for biasing the process cartridge in the connecting direction of a connector after attaching the process cartridge to the main body of the apparatus was proposed already (U.S. Application Ser. No. 08/900,835, now U.S. Pat. No. 5,909,603). According to this proposition, since it is detected whether conduction to storage means can be normally performed or not after the reliability of connection between the connectors by the biasing means is promoted, there is a merit in that a decision on whether a process cartridge is attached or not is accurately discriminable from a decision on whether storage means is abnormal or not.

The present invention is further improved so as to make this discrimination more correct.

SUMMARY OF THE INVENTION

Made in consideration of the above problems, the present invention has one object in providing an image forming apparatus allowing a user to easily recognize the status thereof.

It is another object of the present invention to provide an image forming apparatus capable of accurately deciding whether a unit is attached to the main body of the apparatus or not.

It is still another object to provide an image forming apparatus capable of accurately deciding whether storage means of a unit is normal or not.

It is still another object to provide an image forming apparatus capable of accurately discriminating between a decision on whether a unit is attached to the main body of the apparatus or not and a decision on whether storage means of a unit is normal or not.

It is yet another object to provide an image forming apparatus, comprising a unit detachably attachable to a main body of the apparatus wherein the detachable unit comprises information storage means, unit attachment detecting means for detecting whether the unit is attached to the main body of the apparatus or not, biasing means for biasing the detachable unit so that an information transmission can be properly made between the main body of the apparatus and the information storage means, wherein the biasing means is operable when the attachment of the detachable unit is detected by the unit attachment detecting means and information transmission detecting means for detecting whether information transmission is executable between the information storage means and the main body of the apparatus or not, wherein the information transmission detecting means starts a detecting operation after the working of the biasing means.

Further objects of the present invention will be apparent by reading the following detailed description while referring to the attached drawings.

DETAILED DESCRIPTION OF THE PREFERRED EMBODIMENTS

Figure 1:
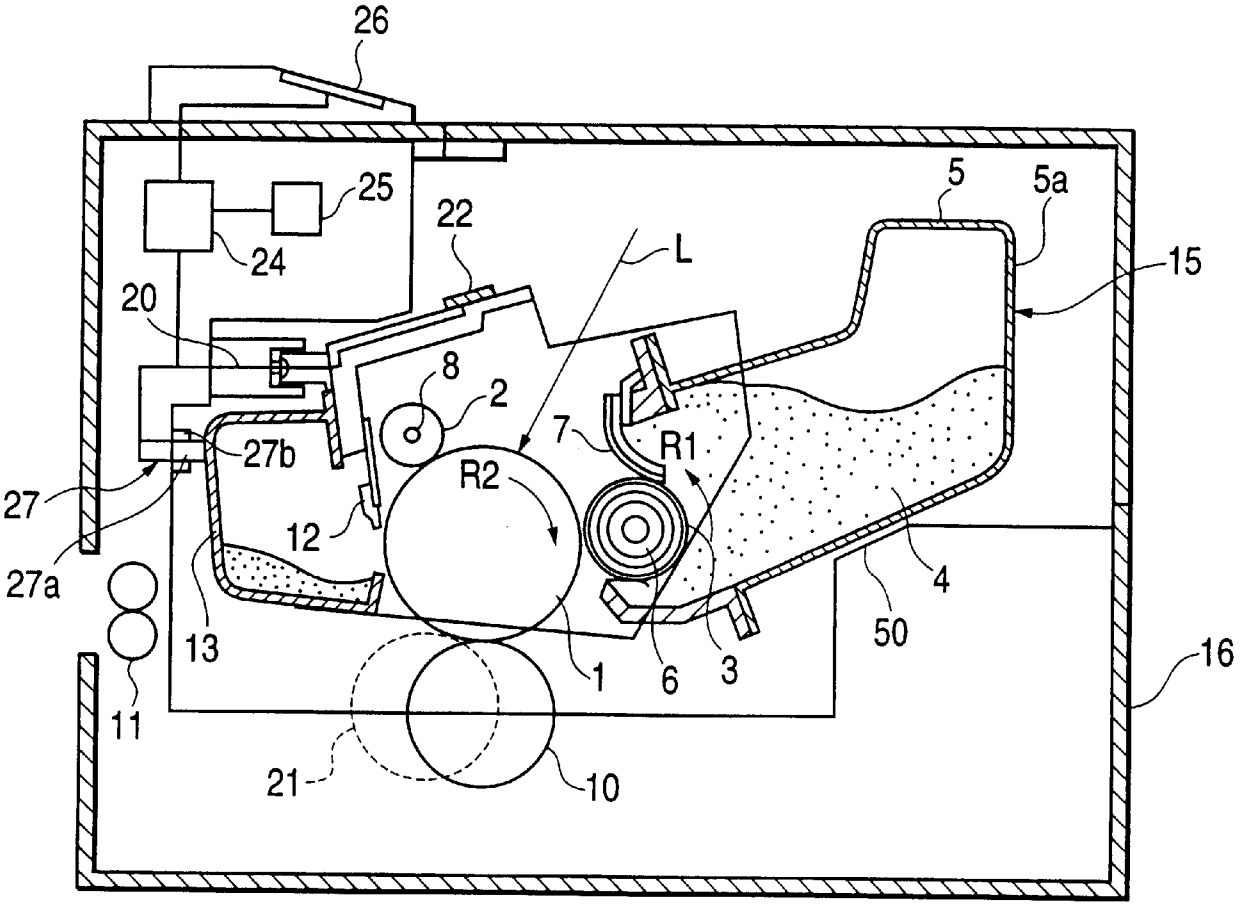
FIG. 1 is a block diagram showing an image forming apparatus and a process cartridge according to an embodiment 1 of the present invention.

Hereinafter, referring to the drawings, an image forming apparatus according to the present invention will be described in further detail.

Embodiment 1

The embodiment 1 of the present invention will be described referring to FIGS. 1 to 5.

FIG. 1 shows a process cartridge 15 on which a photosensitive drum 1 of electrophotographic photosensitive body, a charging roller 2 as charging means, a developing device 5 as developing means, a cleaning blade 12 as cleaning means, etc. are integrally constructed and an electrophotographic image forming apparatus. The process cartridge 15 is detachably attached to the main body of the image forming apparatus along attaching means 50.

Also, in FIG. 1, the developing device 5 comprises a developing container 5*a* for containing a developer 4, a developing sleeve 3 as a developer bearing member provided extendedly opposite the photosensitive drum 1 at the opening thereof and an elastic blade 7 as a developer regulating member for regulating the amount of developer borne by the developing sleeve 3. The developing sleeve 3 is formed of a pipe material, e.g. made of aluminum or the like, inside which a magnet 6 with a plurality of magnetic poles N and S formed alternately is installed immovably to the rotation of the developing sleeve 3. And, by a magnetic action force of the magnet 6, the developer 4 is borne on the surface of the developing sleeve 3 rotating in the direction of the arrowhead R1 in FIG. 1.

Also, the elastic blade 7 abuts against the film of the developer 4 with the loop of its free end, extending in a direction opposite to the rotating one of the developing sleeve 3 designated with the arrowhead R1 in FIG. 1, to regulate the film thickness thereof when the developer 4 borne by the developing sleeve 3 passes the abutted position and thereby a thin layer of the developer 4 is formed on the developing sleeve 3.

To the charging roller 2 with a core metal 8 provided inside is applied a vibrating voltage composed of an AC voltage and a DC voltage put one over the other via a slidable electrode (not shown) in contact with the core metal 8 from the power supply (not shown). Thereby, the peripheral surface of the photosensitive drum 1 is treated with contact charging and obtains a predetermined amount of charge.

Then, the charging process surface of the photosensitive drum 1 is scanned and exposed by a laser beams L emitted from a laser scanner loaded on the side of an image forming apparatus to form an electrostatic latent image of the target image information.

The developer 4 on the above developing sleeve 3 is carried to the developing section opposite the photosensitive drum 1 rotating in the direction of the arrowhead R2 by the rotation of the developing sleeve 3 and thereat adheres to the latent image formed on the photosensitive drum 1 under electrical action to accomplish development.

Furthermore, the image formed on the photosensitive drum 1 is transferred to a recording material 12 under the action of the transfer roller 10 provided on the main body 16 of the image forming apparatus, and it is conveyed to the fixing device 11 and fixed by heat and pressure to complete a fixed image on the recording material 12.

On the other hand, the developer 4 remaining on the photosensitive drum 1 in transferring is scraped off with the cleaning blade 12 prior to the re-charging of the photosensitive drum 1 and accumulated in the collected developer containing portion 13.

Also, loaded on a process cartridge 15 according to this embodiment is the storing medium 22. As storing medium 22 of this embodiment, an NV-RAM (Nonvolatile RAM) with a storing capacity of 2 k bytes was used, but a storing medium of magnetic storing medium or the like, for example, may be also available.

In the above NV-RAM 22, the characteristic information about the class and service life of a process cartridge 15 is stored in advance. In this embodiment, at least one item or a combination of a plurality of items was stored among class information items related to the process cartridge 15 such as its sensitivity, its potential, the color and photosensitive body forming layer thickness of a photosensitive drum 1 loaded on the process cartridge, the number of revolutions and the charging period of a photosensitive drum 1, and further the coefficients for calculating the service life on the basis of the number of revolutions and charging period in the photosensitive drum 1.

As others than these, information items such as the production date of a unit required for judging a value of the service life based on the number of image printed sheets and a term for usage may be stored.

Figure 7:
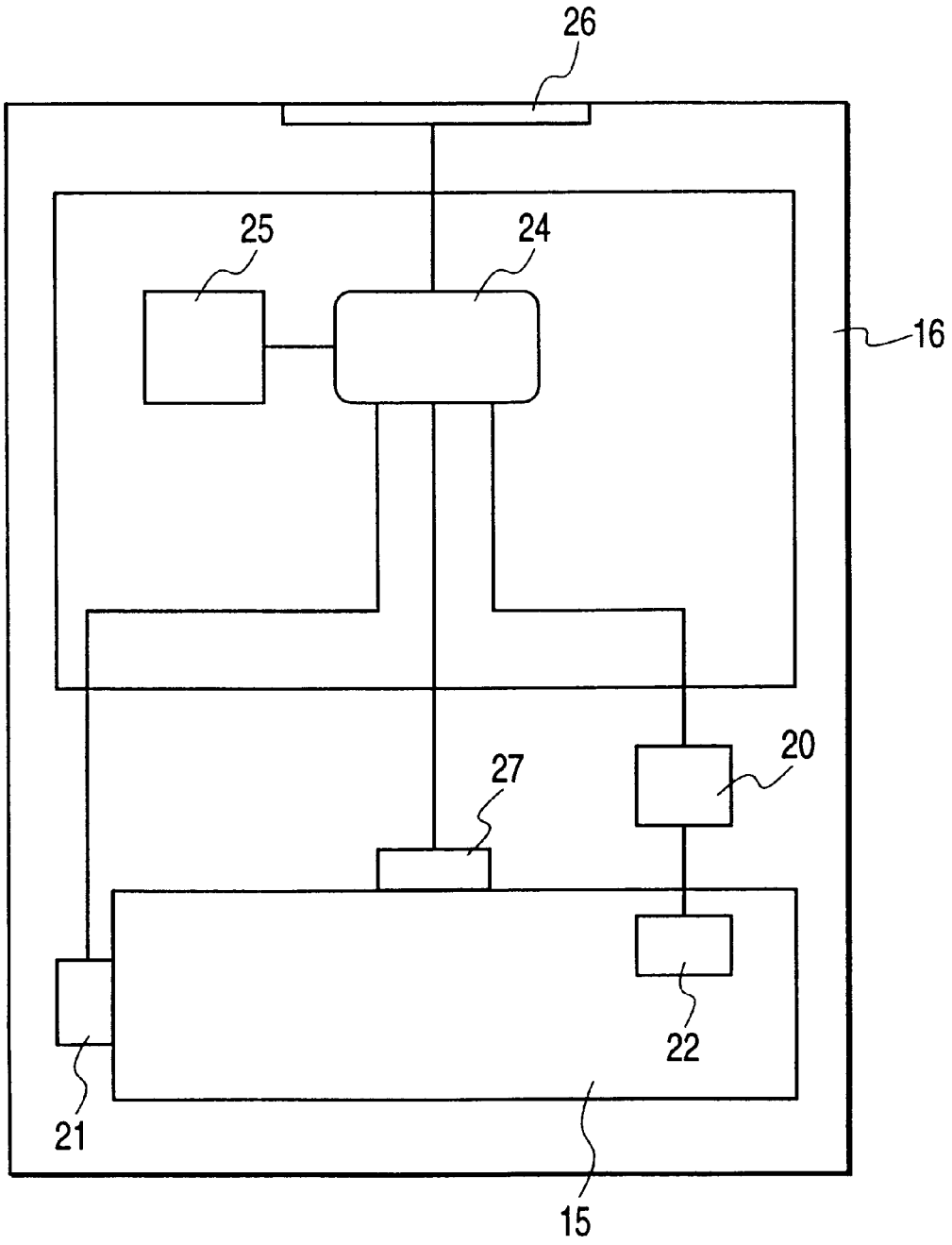
FIG. 7 is a block diagram showing an image forming apparatus and a process cartridge according to an embodiment 2 of the present invention.

As shown in FIGS. 1 and 7, when a process cartridge 15 is attached to a predetermined position of the main body of an image forming apparatus, the NV-RAM 22 is connected to the CPU 24 in the main body 16 of the image forming apparatus via a connector 20 comprising a contact on the main body of the apparatus and a contact on the process cartridge side and further the CPU 24 is electrically connected to a ROM 25 and a display 26.

Furthermore, in the main body 16 of the image forming apparatus according to the present invention, a mechanical switch 27, as process cartridge presence detecting means for detecting the attachment of a process cartridge 15, is additionally provided. When the process cartridge 15 is attached to the main body 16 of the image forming apparatus along the attaching means 50, a working member 27*a*, as acting member, additionally provided at the collected developer container 13, is fitted into the recess part 27*b* of the main body 16 of the image forming apparatus, thereby turning on the mechanical switch 27, so that the attachment is detected.

Figure 2:
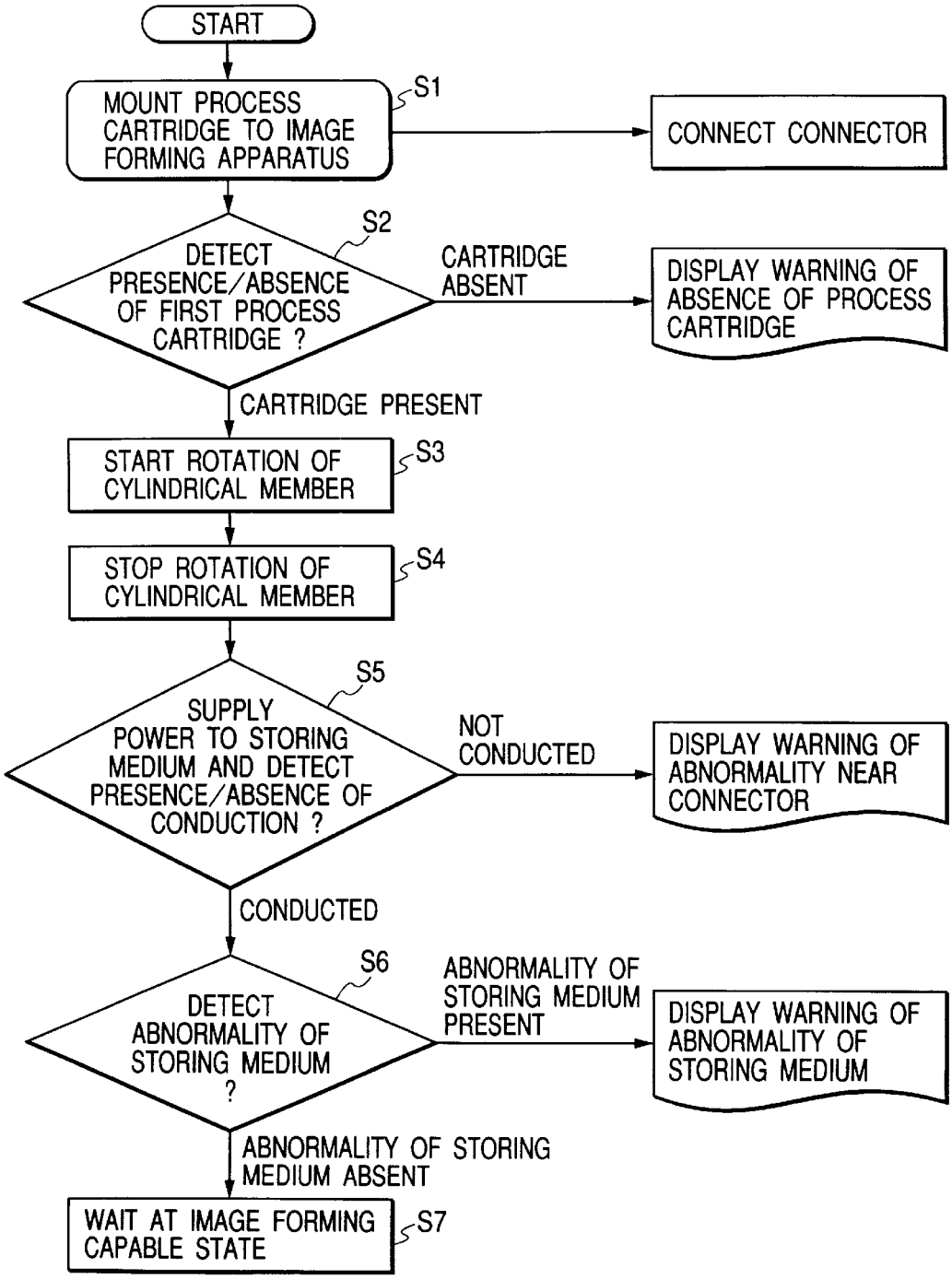
FIG. 2 is a flow chart showing the procedure of detecting the presence/absence of a cartridge and detecting whether a storing medium is abnormal or not, performed in attaching a process cartridge to the main body of an image forming apparatus.
Figure 3:
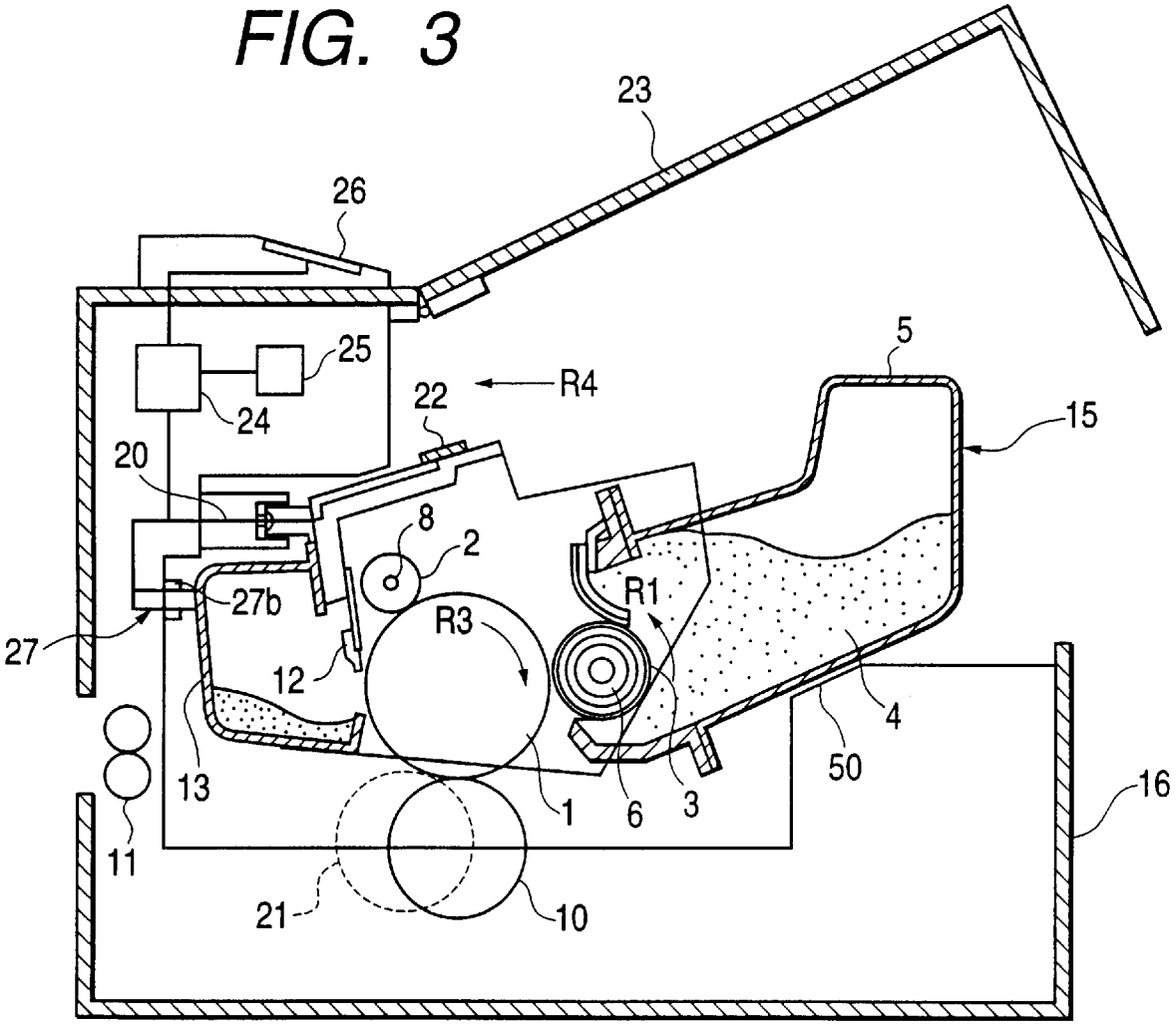
FIG. 3 is an illustration showing the situation of a process cartridge attached to the main body of an image forming apparatus according to the embodiment 1.

Next, the procedure of detecting the presence of a process cartridge and the abnormality of a storing medium, performed at the time of attaching the process cartridge 15 to the main body 16 of the image forming apparatus will be described referring to the flow chart of FIG. 2 and referring to FIG. 3 showing the aspect of the main body 16 of the image forming apparatus and the process cartridge 15 at this time.

In order to perform an image formation in an image forming apparatus according to this embodiment, first, the user opens the cover 23 provided at the main body 16 of the image forming apparatus and attaches a process cartridge 15 to a predetermined position (S1). At this time, the connectors 20 are connected to each other, respectively connected to the main body 16 of the image forming apparatus and the NV-RAM 22 of the process cartridge 15.

Simultaneously with the connection of the above connectors 20, the mechanical switch 27 for detecting the presence of a process cartridge is turned on (S2). When the mechanical switch 27 is not turned on, the CPU 24 loaded on the main body 16 of the image forming apparatus controls the display section 26 to display a written warning "Cartridge Absent" by judging the process cartridge 15 to be unloaded.

Next, the user closes the cover 23 provided at the main body 16 of the image forming apparatus. If the attachment of a process cartridge is detected by the mechanical switch 27, a rotary-type photosensitive drum (cylindrical member) 1 begins to rotate in the direction of arrow R3 in FIG. 3 by the rotation of an image bearer driving gear 21 as driving means (energizing means) provided in the main body 16 of the image forming apparatus (S3), makes three turns and stops rotating (S4). When the mechanical switch 27 is set OFF, the driving gear 21 does not rotate even if the cover 23 is closed.

By this rotation, the process cartridge 15 is biased to the direction of arrow R4 in FIG. 3 and the connectors 20 provided in the main body 16 of the image forming apparatus and the NV-RAM 22 are pushed to each other, so that the connection becomes firm and secure. Namely, if the cartridge is attached at this stage, the reliability of mutual connection in the connectors can be very high.

Figure 4:
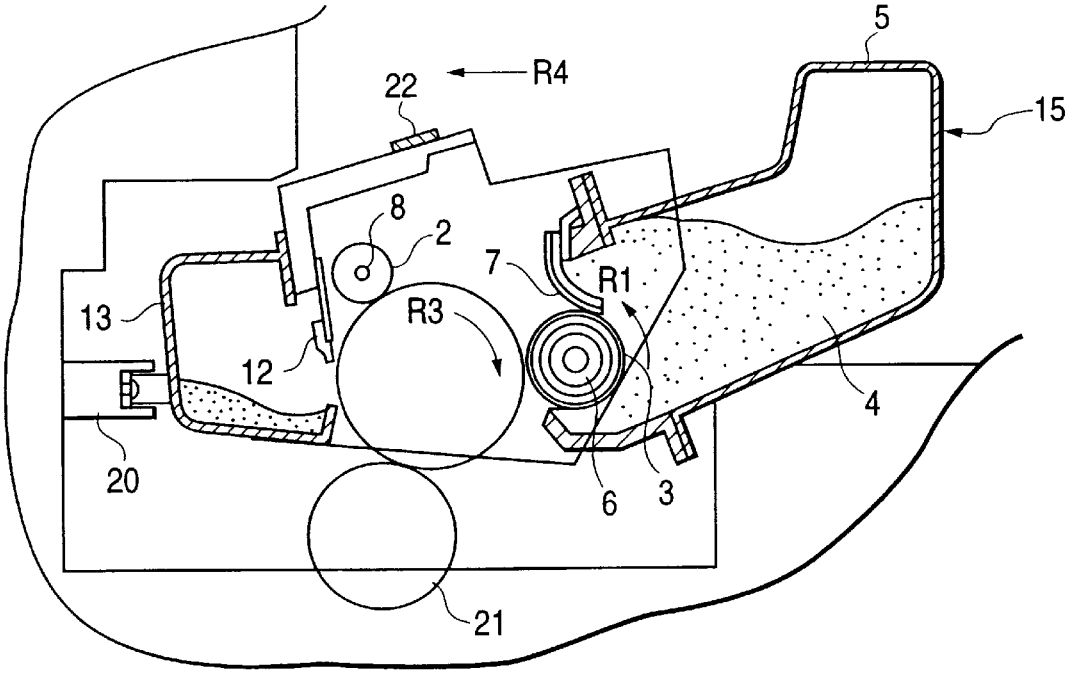
FIG. 4 is an illustration showing a modified example of connection of a connector performed at the attachment of a process cartridge according to the embodiment 1.

Incidentally, in addition to the position shown in FIG. 3, connectors 20 provided in the image forming apparatus and the process cartridge may be located at any position where they are pushed to each other under biasing of the biasing means, such as, e.g. the front end of a process cartridge 15 as shown in FIG. 4, or specifically the outer wall of a collected developer container 13, and a similar effect is obtained.

By supplying power to the NV-RAM 22 at a voltage of 5V from the side of the main body 16 of the image forming apparatus after the rotation stop of the photosensitive drum 1, the connecting condition of connectors 20 is confirmed (S5). Thereby, the presence of a process cartridge is detected once again. Namely, on confirming the electric connection between the NV-RAM 22 and the main body 16 of the image forming apparatus, it is concluded that a process cartridge is present.

If no conduction flow of current is obtained between the main body 16 of the image forming apparatus and the NV-RAM 22 in spite of attachment of a process cartridge, however, the CPU 24 loaded on the image forming apparatus controls the apparatus to display a written warning "Abnormality near Connectors", for example, by judging the NV-RAM 22 or the connectors 20 themselves to be faulty.

On the other hand, on obtaining the current conduction between the main body 16 of the image forming apparatus and the NV-RAM 22, the process cartridge 15 is judged to be attached and the procedure proceeds to the next detecting operation of NV-RAM abnormality (S6).

This detection of NV-RAM abnormality is carried out by the following check sum method.

Figure 5:
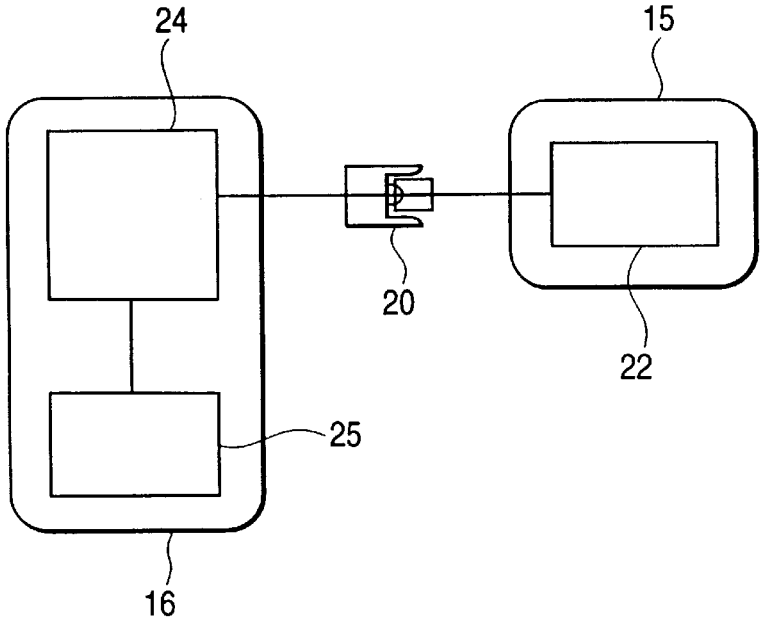
FIG. 5 is a block diagram showing the relation of an NV-RAM loaded on a process cartridge with other constituents.

In FIG. 5, when a peculiar signal expressed in terms of ON-OFF at a fixed value of voltage is sent from the CPU 24 built in the main body 16 of the image forming apparatus to the NV-RAM 22 via the connectors 20, a fixed signal quantified in accordance with the signal cast from the NV-RAM 22 to the CPU 24 is outputted.

Signal input to the NV-RAM 22 is repeated two or more times with the content of a signal changed and the output signals from the NV-RAM 22 are totaled up by the CPU 24.

Afterward, the CPU 24 reads out output values corresponding to the signals issued to the NV-RAM 22, previously stored in the ROM 25 in the main body 16 of the image forming apparatus and calculates the total of them.

Next, the CPU 24 compares the total of output obtained from the NV-RAM 22 with that of output obtained from the ROM 25 in an image forming apparatus and regards the NV-RAM 22 as normal to pass into the image forming operation (S7) if no difference appears between both.

First at this point, quality information items of the process cartridge, such as class and service life of a photosensitive drum 1 stored in the NV-RAM 22 are read out by the CPU 24 and used for reference as setting factors of the control conditions at the time of forming an image.

On the other hand, as a result of comparison between the total of output obtained from the NV-RAM 22 with that of output obtained from the ROM 25 in an image forming apparatus, the CPU 24 controls the display 26 to display the written warning "RAM Abnormal" if a difference appears between both.

By turning on the mechanical switch 27 fitted to the main body 16 of the image forming apparatus through aides of the working member 27*a* provided additionally on a process cartridge 15, an image forming apparatus according to Embodiment 1 first detects whether the process cartridge 15 is present or absent, then, on closing the open-and-close cover 23, rotates the photosensitive drum 1, only if the process cartridge 15 is judged to be present and secures the connection of the connectors 20 provided between the NV-RAM 22 and the main body 16 of the image forming apparatus. Also, when the mechanical switch 27 is not turned on, even closing the open-and-close cover 23 does not result in the rotation of a driving gear 21, so that an unnecessary rotation of the driving gear 21 can be eliminated.

Afterward, on confirming the current conduction of the connector 20, the presence of a process cartridge 15 was detected using the NV-RAM 22, and then by detecting the abnormality of the NV-RAM 22 itself, miss-detection in the presence detection of a process cartridge 15 and the abnormality detection of the storing medium loaded on the process cartridge can be eliminated and the reliability could be improved.

Also, by the provision of mechanical means for detecting the presence of a process cartridge, it is detected securely and in a short time whether a process cartridge is present or absent even if the interior of an image forming apparatus and the process cartridge are polluted with a developer or the like.

Embodiment 2

Next, referring to FIG. 6, the embodiment 2 of the present invention will be described. This embodiment uses an optical switch as means for detecting the presence/absence of a first process cartridge.

Also, as with the embodiment 1, the embodiment 2 employs an NV-RAM (Nonvolatile RAM) having a storing capacity of 2 k bytes as a storing medium 22 loaded on a process cartridge 15, but a storing medium such as, e.g., a magnetically storing medium, is available for this. In the above NV-RAM, quality information items of the process cartridge 15, such as the class and service life of a photosensitive drum, are stored in advance and utilized for the control in forming an image.

Also, the optical switch comprises a light-emitting element 29 and a light-receiving element 30 provided on the side of the main body of an image forming apparatus, while a light-reflecting member 28, as an acting member, is additionally provided on the process cartridge side.

In order to perform an image forming operation in an image forming apparatus according to the present invention, at first, a cover 23 provided on the main body 16 of the image forming apparatus is opened, and a process cartridge 15 is attached to a predetermined position along attaching means 50.

In this condition, simultaneously when the connectors 20 are connected to each other, respectively connected to the main body 16 of the image forming apparatus and the NV-RAM 22 of the process cartridge 15, a route of a ray emitted from the light-emitting element 29 provided in the main body 16 of the image forming apparatus is changed by the light-reflecting member 28 fitted to process cartridge 15. As a result, by receiving the ray in the light-receiving element 30, the process cartridge 15 is recognized to be attached into the main body 16 of the image forming apparatus.

Figure 6:
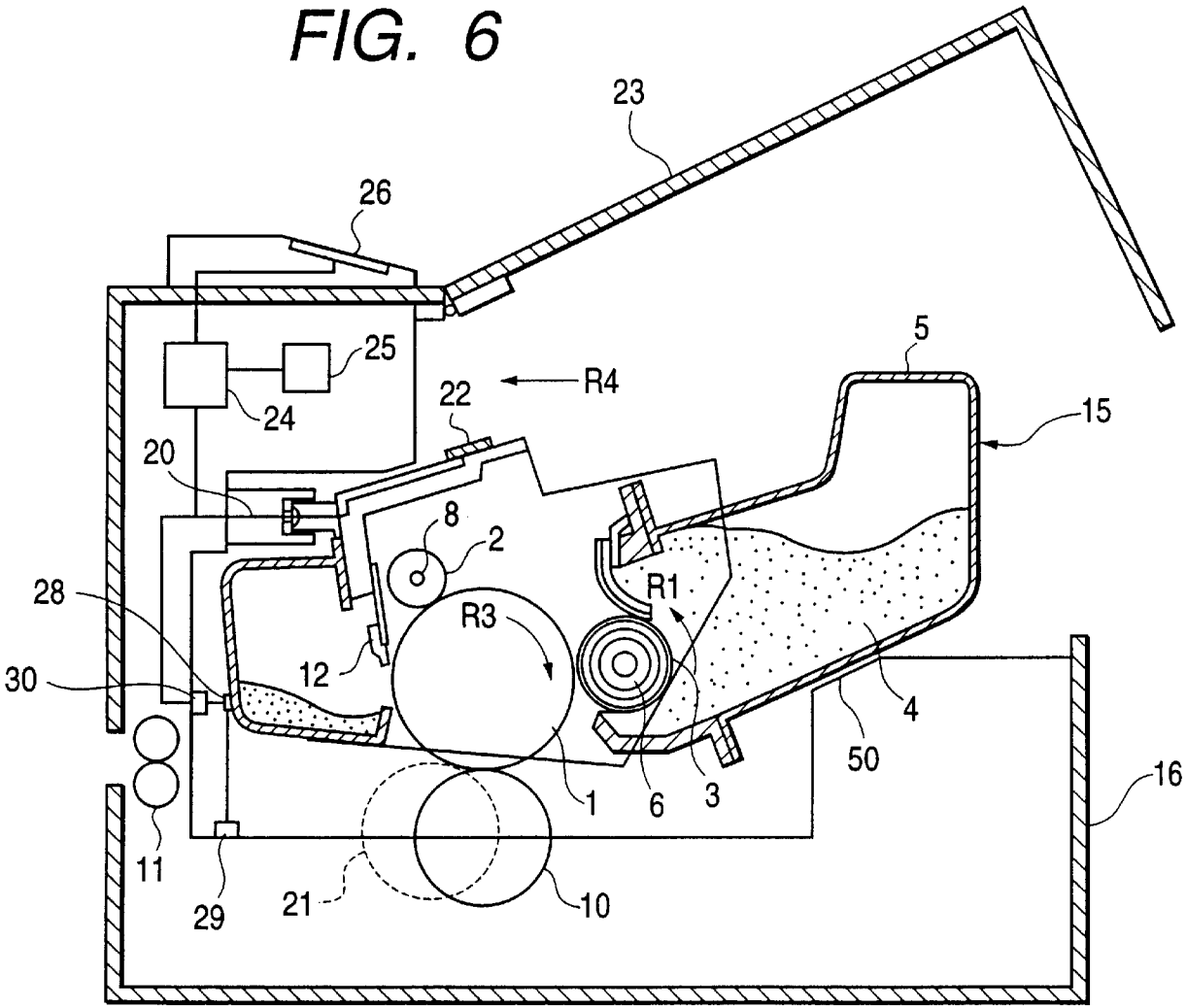
FIG. 6 is an illustration showing the situation of a process cartridge attached to the main body of an image forming apparatus according to an embodiment 2.

Next, on closing the cover 23 provided on the main body 16 of the image forming apparatus, a rotary-type photosensitive drum 1 makes three turns in the direction of R3 in FIG. 6 by the rotation of an image bearer driving gear 21 provided in the main body 16 of the image forming apparatus and the process cartridge 15 is biased to the direction of arrow R4 in FIG. 6. When the light-receiving element 30 does not receive light, the driving gear 21 does not rotate even if the cover 23 is closed.

Consequently, the connectors 20 provided on the main body 16 of the image forming apparatus and the NV-RAM 22 are pushed to each other, so that their connection becomes firm and secure. Namely, if the cartridge is attached at this stage, the reliability of mutual connection in the connectors can be very high.

Incidentally, in addition to the position above the collected developer container 13 as shown in FIG. 6, connectors 20 provided in the main body 16 of the image forming apparatus and the process cartridge 15 may be located at any position where they are pushed to each other by biasing, such as, e.g. the front end of a process cartridge 15 as shown in FIG. 4, and a similar effect is obtained.

In case that no ray is incident on the light-receiving element 30 for detecting whether the process cartridge is present or absent, the process cartridge 15 is regarded as unattached without proceeding to the rotary driving operation of the photosensitive drum 1, and the CPU 24 loaded on the image forming apparatus controls the display section 26 to display the written warning "Cartridge Absent" even on closing the cover 23.

By supplying power to the NV-RAM 22 at a voltage of 5V from the side of the main body 16 of the image forming apparatus after the rotation stop of the photosensitive drum 1, the connecting condition of connectors 20 is confirmed. In this case, on obtaining the electric connection between the NV-RAM 22 and the main body 16 of the image forming apparatus, a process cartridge 15 is judged to be attached and the procedure proceeds to the subsequent abnormality detecting operation of the NV-RAM 22.

If no conduction flow of current is obtained between the main body 16 of the image forming apparatus and the NV-RAM 22 in spite of attachment of a process cartridge 15, however, the CPU 24 loaded on the image forming apparatus controls the display section 26 to display a written warning "Abnormality near Connectors", for example, by judging the NV-RAM 22 or the connectors 20 themselves to be faulty.

Also, the abnormality detection of the NV-RAM 22 is carried out by the following check sum method, while quality information items of the process cartridge, such as the class and service life of a photosensitive drum 1 stored in the NV-RAM 22, are read out by the CPU 24 and used for reference as setting factors of the control conditions at the time of forming an image.

On the other hand, as a result of comparison between the total of output obtained from the NV-RAM 22 with that of output obtained from the ROM 25 in an image forming apparatus, the CPU 24 controls the display 26 to display the written warning "RAM Abnormal" if a difference appears between both.

By turning on the optical switch 27 fitted to the main body of a process cartridge 15, i.e. by the incidence of a ray from the light-emitting element 29 through the reflecting member 28 onto the light-receiving element 30, an image forming apparatus according to the present embodiment first detects the presence of a process cartridge 15, then, on closing the cover 23, rotates the photosensitive drum 1 only if the process cartridge 15 is judged to be present and secures the connection of the connectors 20 provided between the NV-RAM 22 and the main body 16 of the image forming apparatus. Also, when the light-receiving element 30 has no input, even closing the cover 23 does not result in the rotation of a driving gear 21, so that an unnecessary rotation of the driving gear 21 can be eliminated.

Afterward, the connecting condition of the connectors 20 is examined to detect, by use of the NV-RAM 22, whether the process cartridge 15 is present or absent and then the abnormality of the NV-RAM 22 itself is detected. Thereby, miss-detection concerning the image forming apparatus and the process cartridge 15 could be eliminated and the reliability could be promoted.

Also, the light-reflecting member 28 of the optical switch 29 to be fitted to the process cartridge 15 has no need to be brought into contact with and pushed to the main body of an image forming apparatus when a process cartridge is attached, so that manipulability is good and the freedom of configurations is high because of the lack of deformation in the process cartridge.

Furthermore, the provision of optical means for detecting the presence of a process cartridge makes it possible to confirm in a short time whether a process cartridge is present or absent.

Incidentally, in the above embodiments, the photosensitive drum is rotated by the photosensitive drum driving gear to make the connecting state of the connector more secure, but an arrangement may be employed in which the rotation of developing sleeve makes the connecting state of the connector more secure.

Embodiment 3

Figure 8:
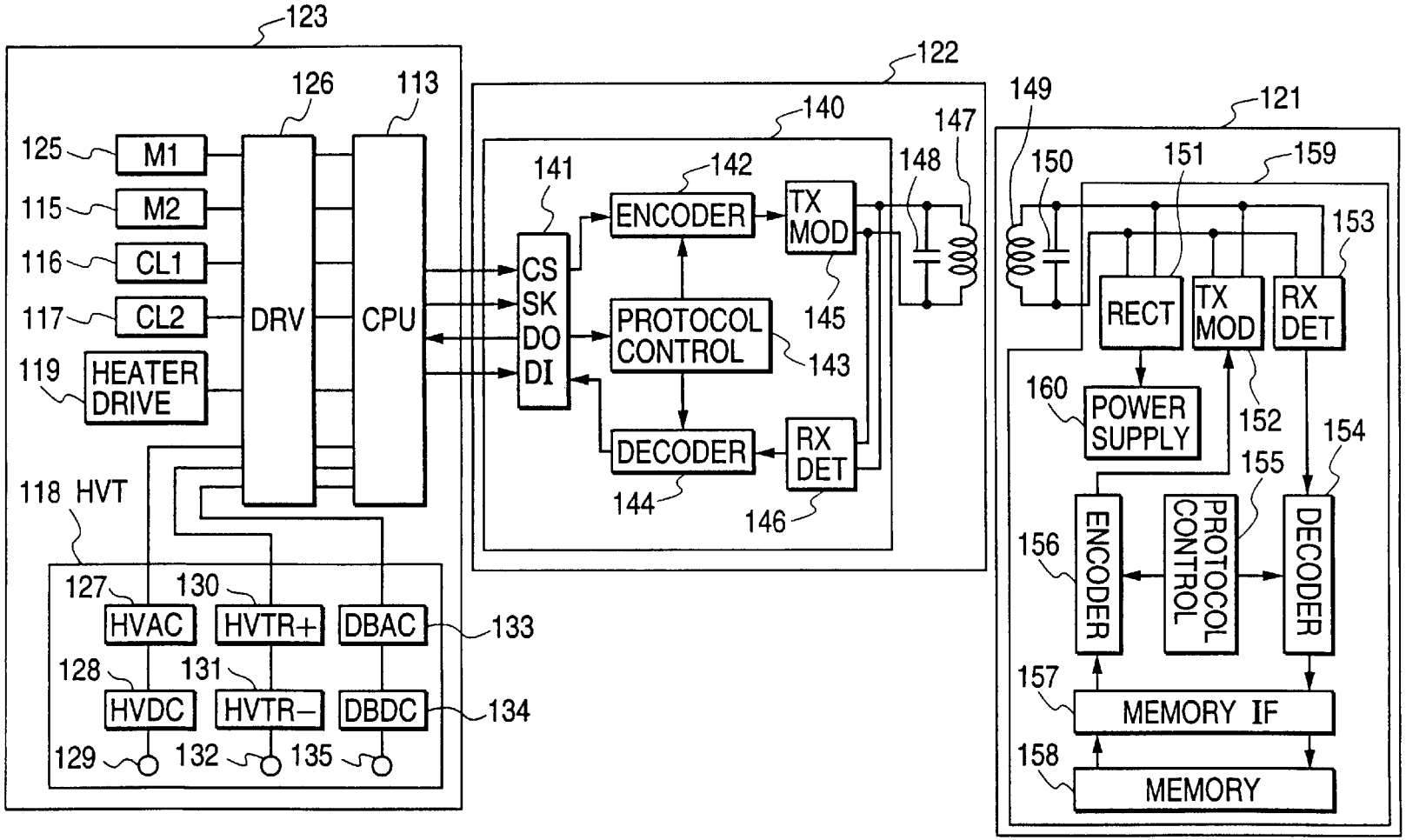
FIG. 8 is a circuit block diagram of an image forming apparatus according to an embodiment 3.
Figure 9:
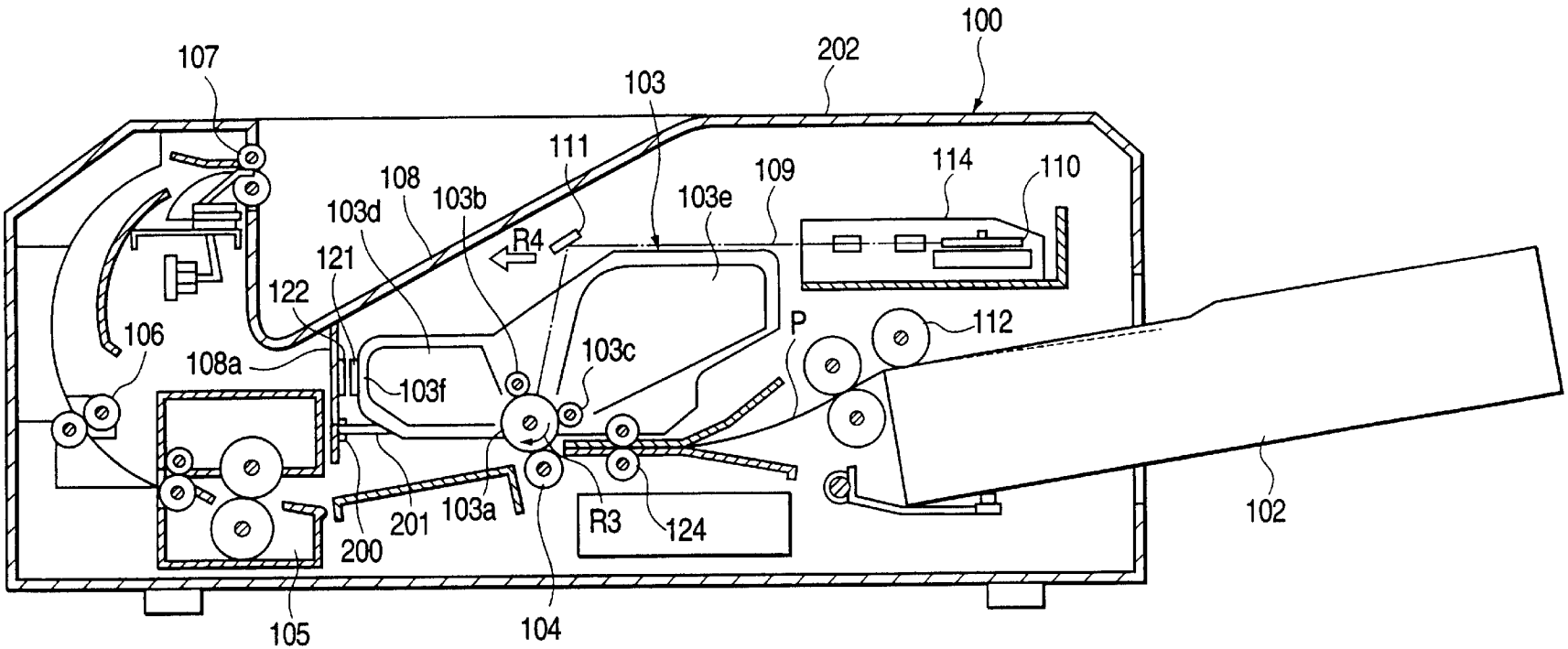
FIG. 9 is a sectional view of the embodiment 3.
Figure 10:
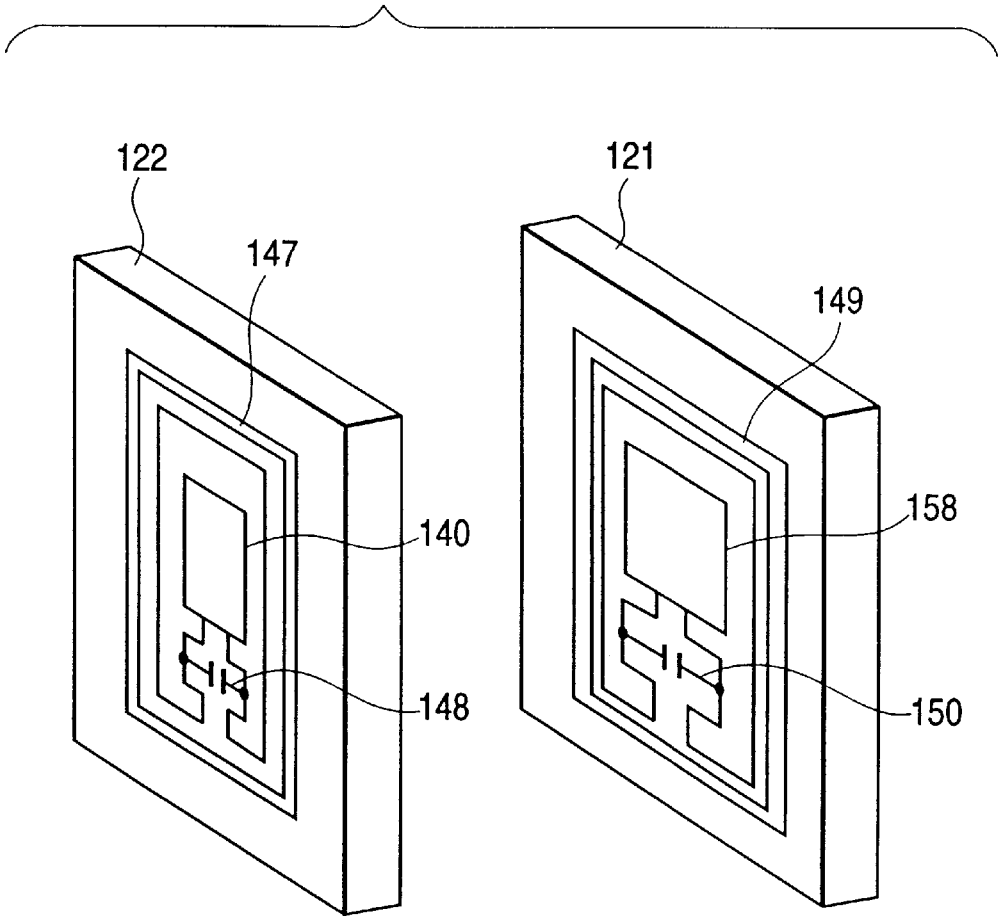
FIG. 10 is a perspective view of a communication unit and a memory unit.

Next, an embodiment is shown FIGS. 8 to 10 which uses a non-contact antenna to make a communication between the main body of the apparatus and the process cartridge in place of the connectors 20 used in Embodiments 1 and 2.

In FIG. 9, a process cartridge 103 is detachably attached to the image forming apparatus. The process cartridge 103 of detachably attachable unit integrally comprises a photosensitive drum 103*a* of image bearing member, a charging roller 103*b* of charging means for charging the surface of the photosensitive drum 103*a* uniformly, a developing roller 103*c* of developing means for making the latent image formed on the photosensitive drum 103*a* into a toner image as visible image, a toner hopper 103*e* for storing a toner, and a cleaner 103*d* as cleaning means for collecting a residual toner on the photosensitive drum 103*a*.

To the wall 103*f* of the process cartridge 103, a non volatile memory unit 121, made of a semiconductor, is fitted. At the position opposed to the non-volatile memory unit 121, an attaching member 108*a* is supported, to which a communication unit 122 on the main body side is fitted.

To the lateral side of the process cartridge 103, a laser scanner unit 114, as image writing means, is provided and scans and exposes the photosensitive drum 103*a* with a laser beam 109 modulated in accordance with the input image signal.

Opposite the bottom face of the photosensitive drum 103*a* is disposed a transfer roller 104 for transferring an image developed on recording paper P picked up by a sheet feed roller 112 from the sheet feed cassette 102, at a transfer timing taken by a registration roller 124.

Downstream of the transfer roller 104 in the conveying direction of a recording material P is provided a fixing device 105 for fixing a toner image transferred to a recording material P under thermal pressure. Downstream of the fixing device 105 is disposed a sheet convey roller 106 and a discharge roller 107 for discharging a recording material P to outside the apparatus.

Hereinafter, the image forming process in an image forming apparatus according to this embodiment will be described.

The surface of the photosensitive drum 103*a* is charged with the charging roller 103*b* and scanned with the laser scanner unit 114 to form a latent image on the surface of the photosensitive drum 103*a*. This latent image is developed by means of the developing roller 103*c* to form a toner image.

On the other hand, the recording material P in the sheet feed cassette 102 is picked up by the sheet feed roller 112, fed to the registration roller pair 124, and conveyed to the transfer position with the timing taken.

At this transfer position, the toner image on the photosensitive drum 103*a* is transferred to the recording material P under action of the transfer roller 104. The toner-image transferred recording material P is conveyed to the fixing device 105 and fixed thermally and under pressure. Thereafter, the recording material P is discharged to outside the main body 100 of the image forming apparatus by means of the discharge roller 107 and stacked on the tray 108.

FIG. 8 is a block diagram showing the configuration of an image forming apparatus for explaining the embodiment 3 of the present invention.

In FIG. 8, the image forming control circuit 123 controls a main motor 125, a scanner motor 115, a sheet feed clutch 116, a registration clutch 117, a high-pressure unit 118, a fixing device heater drive circuit 119, etc., which control is performed for the image forming operation of the image forming apparatus 100.

For this purpose, the image forming control circuit 123 loads the CPU 113, composed of a one-chip microcomputer and the drive circuit 126, while the drive circuit 126 is equipped with a main motor 125 for driving the photosensitive drum 103*a*, the sheet feed roller 112, the registration roller 124, other rollers and the fixing device 105, a scanner motor 115 included in the scanner unit 114, a sheet feed clutch 116 for controlling the sheet feed roller 112, a registration clutch 117 for controlling the registration roller 124, a high-voltage unit (HVT) 118 for supplying a high voltage to the charging roller 103*b*, the developing roller 103*c* and the transfer roller 104 and a fixing device heater drive circuit 119 for driving the heater in the fixing device 105.

The high-voltage unit 118 comprises three types of high-voltage power supplies for charging, developing and for transferring the photosensitive drum 103*a*.

The high-voltage power supplies for charging outputs its power, composed of high-voltage AC (HVAC) output 127 and high-voltage DC (HVDC) output 128 put one over the other, from its output terminal 129 to the charging roller 103*b*.

The high-voltage power for transfer outputs its switchable output of high-voltage plus DC (HVTR+) 130 and high-voltage minus DC (HVTR-) 131 from its terminal 132 to the transfer roller 104. The high-voltage power supplies for development outputs its power, composed of high-voltage AC (DBAC) output 133 and high-voltage DC (DBDC) output 134 put one over the other, from its output terminal 135 to the developing roller 103*c*.

A nonvolatile memory 121 attached to the process cartridge stores the used time or the like of the photosensitive drum 103*a* and is used to discriminate the service life or the like of the photosensitive drum 103*a*.

The communication unit 122 comprises a coil attached to an IC for the communication with the memory unit 121.

The communication unit 122 on the main body side will be described in further detail.

The communication unit 122 is equipped with an IC 140 including the modulation and demodulation circuits for the communication, the IC 140 includes the serial signal interface section 141 directly communicating with the CPU 113 and the interface section 141 comprises a CS terminal, as an input terminal of a chip select signal, an SK terminal as an input terminal of a serial clock, a DO terminal as an output terminal of a serial signal and a DI terminal as an input terminal of a serial signal.

The serial signal serves to set the address of the memory, instruct read/write and load data stored in the memory and data read out from the memory on the same signal line in time series.

Furthermore, the IC 140 comprises an encoder 142, a protocol controller 143, a decoder 144, a modulator 145 for transmission, and a demodulator 146 for reception.

A serial signal from the CPU 113 is converted into a protocol fit for communication by a protocol controller 143, loaded on an encoder 142 and outputted from a transmit modulator 145 as high-frequency signal. The received data are demodulated from high-frequency signals into base-band signals by a demodulator 146, decoded into serial signals fit for the CPU 113 by the decoder 144 and sent through the interface section 141 to the CPU 113.

The communication unit 122 has a tank circuit comprising a coil 147 as second antenna for sending/receiving a high-frequency signal as an electromagnetic wave and a capacitor 148.

As shown in FIG. 10, the communication unit 122 is so constructed as to be sealed in a flat mold case.

Next, referring to FIG. 8 again, the circuits on the memory side will be described.

The memory unit 121 first has a tank circuit comprising a coil 149 as first antenna for sending/receiving a high-frequency signal and a capacitor 150.

Connected to this tank circuit are a rectifier circuit 151, a transmit modulator circuit 152 and a demodulator 153. Output of the rectifier circuit 151 is connected to the power supply circuit 160, thereby leading to the supply of power to the memory IC 158. Furthermore, the memory unit 121 comprises a decoder 154, a protocol controller 155, an encoder 156, a memory interface circuit 157 and a non volatile memory 158 such as EEPROM or ferroelectric memory.

After the demodulation from a high-frequency signal to a base-band signal at the demodulator 153, the resultant signal is converted into a signal fit for sending to the memory 158 at the decoder 154 in accordance with the control of protocol controller 155.

And, this signal is divided into address and data at the memory interface circuit 157 and a read/write operation is executed into/from the memory 158 in accordance with a read/write command.

The data read out from the memory 158 are sent through the memory interface 157 to the encoder 156, converted into a protocol fit for the communication and sent through the transmit modulator 152 to the tank circuit.

As shown in FIG. 10, this memory unit 121, comprising an IC 159 integrated of the modulator/demodulator and the memory, the coil 149 and the capacitor 150, is configurated so as to be sealed in a flat mold case.

In order to perform an image forming in an image forming apparatus according to this embodiment, the user first opens a cover 202 provided on the main body 100 of the image forming apparatus and house a process cartridge 103 to a predetermined position.

In this condition, simultaneously when the antennas 147 and 149 are brought close to each other, respectively connected to the main body 100 of the image forming apparatus and the NV-RAM of the process cartridge 103, a mechanical switch 200 provided in the main body 100 of the image forming apparatus is pushed by a working member 201 provided on the process cartridge 103 and turned on. Thereby, the process cartridge 103 is recognized to be attached to the main body 100 of the image forming apparatus.

Next, on closing the cover 202 provided on the main body 100 of the image forming apparatus, a rotary-type photosensitive drum 103*a* makes three turns in the direction of R3 in FIG. 9 by the rotation of an image bearing member driving gear (not shown) provided in the main body 100 of the image forming apparatus and the process cartridge 103 is biased to the direction of R4 in FIG. 9. In OFF case of the switch 200, the driving gear does not rotate even if the cover 202 is closed.

Consequently, the antennas 147 and 149 provided on the communication unit 122 of the main body 100 of the image forming apparatus and the memory unit 121 come close to each other, thus leading to a securely communicable state. Namely, if the cartridge is attached at this stage, it is said that the reliability of communication between the antennas can be very high.

Incidentally, the communication unit 122 and the memory unit 121 may be installed at any positions other than the side wall of the collected developer container 103*d* as shown in FIG. 9.

When the switch 200 does not have input, the process cartridge 103 is regarded as unattached without proceeding to the rotary driving operation of the photosensitive drum 103*a*, the CPU loaded on the image forming apparatus controls the display section to display the written warning "Cartridge Absent" even on closing the cover.

By applying a current to the above memory 158 at a voltage of 5V from the side of the main body 100 after the rotation stop of the photosensitive drum 103*a*, the position of the antenna 149 is confirmed. In this case, if a communication can be made between the memory 158 and the main body 100 of the image forming apparatus of an image forming apparatus, the process cartridge 103 is judged to be attached and the procedure proceeds to the subsequent abnormality detecting operation of the memory.

If no normal communication can be made between the main body 100 of the image forming apparatus and the memory 158 in spite of attachment of the process cartridge 103, however, the CPU loaded on the image forming apparatus controls the display section to display a written warning "Abnormality near Memory", for example, by regarding the memory unit itself 121 as faulty.

Also, the abnormality detection of the memory 158 is carried out by the following check sum method, while quality information items of the process cartridge 103 such as class and service life of a photosensitive drum 103*a* stored in the memory 158 are read out by the CPU and used for reference as setting factors of the control conditions at the time of forming an image.

On the other hand, as a result of comparison between the total of output obtained from the memory 158 with that of output obtained from the ROM in an image forming apparatus, the CPU controls the display to display the written warning "Memory Abnormal" if a difference appears between both.

By turning on the mechanical switch 200, an image forming apparatus according to this embodiment first detects the presence of a process cartridge 103, then, on closing the cover, rotates the photosensitive drum only if the process cartridge 103 is judged to be present and secures the communication between the memory unit 121 and the communication unit 122 of the main body of the apparatus. Also, when the mechanical switch 200 does not have input, even closing the cover does not result in the rotation of a driving gear, so that an unnecessary rotation of the driving gear can be eliminated.

Afterward, the communicating conduction is examined to detect, by use of the memory 158, whether the process cartridge 103 is present or absent and then the abnormality of the memory itself 158 is detected. Thereby, miss-detection concerning the image forming apparatus and the process cartridge 103 can be eliminated and the reliability can be promoted.

The present invention is not limited to the above embodiments, but includes modifications of the same technical idea also.

What is claimed is:

1. An image forming apparatus, comprising:

a unit detachably attachable to a main body of said apparatus, said unit having information storage means;

a unit attachment detecting switch for detecting whether said unit is attached to the main body of said apparatus or not;

biasing means for biasing said unit so that an information transmission can be properly effected between the main body of said apparatus and the information storage means, said biasing means being operable when an attachment of said unit is detected by said unit attachment detecting switch; and information transmission detecting means for detecting whether information transmission is executable between said information storage means and the main body of said apparatus or not, wherein said information transmission detecting means starts a detecting operation after said biasing means is operated.

2. An image apparatus according to claim 1, further comprising an open-and-close cover for taking in and out said unit, wherein said biasing means operates when the attachment of said unit is detected by said unit attachment detecting switch and said cover is closed.

3. An image forming apparatus according to claim 1, wherein said biasing means has a driving gear meshed with a gear of said unit and said unit is biased by rotation of said driving gear.

4. An image forming apparatus according to claim 3, wherein said unit further has an image bearing member.

5. An image forming apparatus according to claim 4, wherein the gear of said unit meshing with said driving gear is integrated with said image bearing member.

6. An image forming apparatus according to claim 4, wherein said image bearing member is an electrophotographic photosensitive body.

7. An image forming apparatus according to claim 4, wherein said unit further has at least one of charging means for charging said image bearing member, developing means for developing a latent image formed on said image bearing member, and cleaning means for cleaning said image bearing member.

8. An image forming apparatus according to claim 1, wherein said unit further has a connector electrically connected to said information storage means and said connector is fitted with a connector of the main body of said apparatus when said unit is attached to the main body of said apparatus.

9. An image forming apparatus according to claim 8, wherein said unit is biased in such a direction as to connect said connectors each other when said biasing means is operating.

10. An image forming apparatus according to claim 1, wherein said unit further has an antenna electrically connected to said information storage means and said antenna is opposed to an antenna of the main body of said apparatus when said unit is attached to the main body of said apparatus.

11. An image forming apparatus according to claim 10, wherein said unit is biased so that said antennas are properly opposed to each other when said biasing means is operating.

12. An image forming apparatus according to claim 1, wherein said information storage means is a semiconductor memory.

13. An image forming apparatus according to claim 1, wherein said unit attachment detecting switch deviates by partly abutting of said unit.

14. An image forming apparatus according to claim 1, wherein said unit attachment detecting switch has a light-emitting element and a light-receiving element and optically detects whether said unit is attached to the main body of said apparatus or not.

* * * * *

UNITED STATES PATENT AND TRADEMARK OFFICE

CERTIFICATE OF CORRECTION

PATENT NO. : 6,137,966
DATED : October 24, 2000
INVENTOR(S) : Shinji Uehara et al.

It is certified that error appears in the above-identified patent and that said Letters Patent is hereby corrected as shown below:

Column 1,
Line 40, "as," should read -- as --.

Column 14,
Line 30, "each" should read -- to each --.
Line 46, "of" should be deleted.

Signed and Sealed this

Twenty-ninth Day of January, 2002

*Attest:*

*Attesting Officer*

JAMES E. ROGAN
*Director of the United States Patent and Trademark Office*